US008046916B2

(12) United States Patent
Hagiwara et al.

(10) Patent No.: US 8,046,916 B2
(45) Date of Patent: Nov. 1, 2011

(54) METHOD OF, AND APPARATUS FOR, MANUFACTURING METALLIC BELLOWS

(75) Inventors: Yoshitoshi Hagiwara, Shizuoka (JP); Tetsuaki Nakayama, Shizuoka (JP); Nobuyuki Yoshitoshi, Shizuoka (JP)

(73) Assignee: Yutaka Giken Co., Ltd., Shizuoka (JP)

( * ) Notice: Subject to any disclaimer, the term of this patent is extended or adjusted under 35 U.S.C. 154(b) by 984 days.

(21) Appl. No.: 12/003,191

(22) Filed: Dec. 20, 2007

(65) Prior Publication Data

US 2008/0155806 A1 Jul. 3, 2008

(30) Foreign Application Priority Data

Dec. 21, 2006 (JP) ..... 2006-344783

(51) Int. Cl.

| | |
|---|---|
| ***B21D 15/00*** | (2006.01) |
| ***B21D 15/06*** | (2006.01) |
| ***B21D 53/06*** | (2006.01) |
| ***B21D 19/04*** | (2006.01) |

(52) U.S. Cl. ..... 29/890.08; 29/454; 29/890.045; 72/59; 72/110

(58) Field of Classification Search ..... 29/454, 29/890.08, 890.045, 890.144; 72/59, 110, 72/105; 138/121

See application file for complete search history.

(56) References Cited

U.S. PATENT DOCUMENTS

| | | | | |
|---|---|---|---|---|
| 2,358,291 | A * | 9/1944 | Fentress | 285/275 |
| 2,663,324 | A * | 12/1953 | Fentress | 138/121 |
| 2,685,305 | A * | 8/1954 | Woods | 138/121 |
| 3,595,049 | A * | 7/1971 | Holt | 72/110 |

FOREIGN PATENT DOCUMENTS

| | | | |
|---|---|---|---|
| JP | 54-94469 | A | 7/1979 |
| JP | 56-068535 | A | 6/1981 |
| JP | 57-009548 | A | 1/1982 |
| JP | 09-001249 | A | 1/1997 |

OTHER PUBLICATIONS

Notification of Rejection Reasons for Japanese Patent App. No. 2006-344783 (Jun. 15, 2010).

* cited by examiner

*Primary Examiner* — David Bryant
*Assistant Examiner* — Alexander P Taousakis
(74) *Attorney, Agent, or Firm* — Cermak Nakajima LLP; Tomoko Nakajima

(57) ABSTRACT

A metallic bellows is manufactured by a first step of bulging a straight raw pipe into a primary formed body having formed on a periphery thereof a corrugated bellows section, and a second step of subjecting at least one of crest portions and trough portions of the bellows section of the primary formed body to roll machining by means of a pair of forming rolls.

10 Claims, 5 Drawing Sheets

ROLL MACHINING

COMPRESSION FORMING

METHOD OF, AND APPARATUS FOR, MANUFACTURING METALLIC BELLOWS

BACKGROUND

1. Technical Field

The present invention relates to a method of manufacturing a metallic bellows and to an apparatus for manufacturing a metallic bellows. It relates, in particular, to a method of, and an apparatus for, manufacturing a metallic bellows which is used in a flexible tube to be interposed in an exhaust pipe for a vehicle such as a motor vehicle.

2. Related Art

Generally, a flexible tube using a metallic bellows is interposed on the way to outlet of an exhaust pipe of a vehicle such as a motor vehicle. This flexible tube serves the purpose of absorbing the vibrations from an engine of the motor vehicle, thereby preventing the vibrations from being transmitted to such a part as a muffler on a downstream side of the exhaust system. This kind of metallic bellows is conventionally known to be manufactured in the following method.

Specifically, both end portions of a raw pipe are fitted into a pair of upper and lower end dies. A plurality of intermediate annular dies are interposed at an equal interval from one another between the end dies. Thereafter, in a state in which both ends of the raw pipe are hermetically sealed, there is performed an operation of forming or machining known by the name of bulging which makes use of fluid pressure such as hydraulic pressure or a suitable deformable pressure medium such as urethane rubber, and the like. In this manner, the raw pipe is expanded from the inner side and is also swelled at the portions which form crest (or mountain) portions. Then, the end dies are respectively moved toward each other to thereby perform compression-forming until the intermediate annular dies are brought into close contact with one another. A metallic bellows is thus manufactured. JP-A-1249/1997 is an example of relevant prior art; see for example the description of the prior art.

In the above-described example, the pressure is applied from the inside at the time of bulging to thereby radially swell the portions which form the crest portions of the bellows. As a consequence, there is a problem in that the plate thickness at the crest portions becomes smaller than that at trough (valley) portions, thereby resulting in nonuniform plate thicknesses at the bellows section. Further, there is also another problem in that the shapes of the crest portions and the trough portions are unstable (i.e., the shapes of the U-shaped end portions of the crest portions and the trough portions become irregular).

The spring constant of a metallic bellows can be made smaller by reducing the plate thicknesses at the crest portions and the trough portions of the bellows section. However, in the manufacturing method as described above in which there occurs a difference in plate thicknesses between the crest portions and the trough portions of the bellows section, there is a limit to an attempt to minimize the plate thicknesses. In particular, in an example in which the raw pipe is manufactured with a sheet of metallic plate which is die-cut (or stamped) into a predetermined shape and the free ends thereof are then joined together for welding them together, the welded joint is likely to be damaged. Therefore, it was difficult to reduce the thicknesses at the crest portions and the trough portions of the bellows section. It may then be considered to make the spring constant smaller by increasing the axial length of the bellows section or by enlarging the distances between the respective adjoining crest portions and the trough portions at the bellows section. However, this solution has a problem in that the flexible tube becomes larger in size and weight.

SUMMARY

It is an object of the invention to provide a method of manufacturing a metallic bellows in which the plate thicknesses and the shapes of the crest portions and the trough portions at the bellows section can be made substantially uniform with a small spring constant. It is another object of the invention to provide an apparatus for manufacturing a metallic bellows, the apparatus being suitable for manufacturing a metallic bellows in which the plate thickness and the shapes of the crest portions and the trough portions of the bellows section are substantially uniform with a small spring constant.

In order to solve the above problems and attain the above and other objects, according to one aspect of the invention, there is provided a method of manufacturing a metallic bellows including a first step of bulging a straight raw pipe into a primary formed body having formed on a periphery thereof a corrugated bellows section, wherein the method further comprises a second step of subjecting at least one of crest portions and trough portions of the bellows section of the primary formed body to roll machining by means of a pair of forming rolls.

According to this configuration, the metallic bellows is manufactured in two separate steps, i.e., a step of bulging a straight raw pipe into a primary formed body having formed on a periphery thereof a corrugated bellows section, and a step of forming the crest portions or the trough portions of the bellows section by roll machining. Therefore, even if the plate thickness at the crest portions or the trough portions becomes nonuniform in the step of bulging, the plate thickness and the shape of the crest portions and the trough portions can be made uniform by subjecting to roll machining, the trough portions which are particularly likely to become greater in plate thickness. As a consequence, the spring constant of the metallic bellows can be made smaller, resulting in minimizing in size of the flexible tube.

Preferably, the second step further comprises: inserting a first forming roll into the primary formed body; applying an urging force to a second forming roll toward the first forming roll in a state in which annular projections formed on a periphery of one of the first forming roll and the second forming roll are radially in contact with one of trough portions and crest portions of the bellows section; and rotating the first forming roll in a state in which the urging force by the second forming roll is being applied thereto, until a periphery of one of the crest portions and the trough portions is restricted by annular restricting grooves formed on a periphery of the other of the first forming roll and the second forming roll.

According to this configuration, by means of the urging force from the projections, each of the trough portions is uniformly elongated (or expanded) to a thinner plate thickness over the entire circumference until it is restricted by the corresponding restricting groove. Also, each of the trough portions is formed substantially into a U-shape due to the corresponding restricting groove, resulting in a substantially uniform plate thickness and shape of the crest portions and the trough portions at the bellows section.

Further, in order to improve the productivity, preferably, the annular projections and the restricting grooves are formed on both the first forming roll and the second rolling form, respectively, in number corresponding to the number of the crest portions or the trough portions of the primary forming roll, such that the urging force can be applied by the annular projections to all the crest portions or the trough portions of the bellows section. According to this configuration, all the crest portions or the trough portions of the bellows section can be roll-machined in single step.

Still furthermore, preferably the annular projections and the restricting grooves are formed respectively on the periphery of the first forming roll and the second forming roll in a staggered manner, the radial height of the annular projections of the first forming roll varying from the radial height of the annual projections of the second forming roll, such that, when the urging force is applied by the second forming roll, the periphery of the trough portions is restricted by the restricting grooves of the first forming roll, and that the periphery of the crest portions is restricted by the restricting grooves of the second forming roll.

According to this configuration, there can be performed, in a single step, the work of correcting the shape and further reducing the plate thickness of the crest portion whose plate thickness becomes smaller at the time of bulging, and the work of correcting the shape and reducing the plate thickness of the trough portion based on the plate thickness of the crest portion. In this manner, there can be attained a higher productivity. In addition, the spring constant of the metallic bellows can further be made smaller.

According to another aspect of the invention, there is provided an apparatus for manufacturing a metallic bellows comprising: bulging means for bulging a straight raw pipe so as to form a corrugated bellows section on a periphery of the straight raw pipe, thereby obtaining a primary formed body; roll-machining means for subjecting at least one of crest portions and trough portions of the bellows section of the primary formed body to roll machining, the roll-machining means having a pair of forming rolls, one of the forming rolls having formed on a periphery thereof annular projections which come into radial contact with the crest portions or the trough portions of the bellows section, the other of the forming rolls having formed on a periphery thereof annular restricting grooves which restrict the periphery of the crest portions or the trough portions of the bellows section; urging means, disposed on the other of the forming rolls, for applying a radial urging force to the primary formed body in a state in which one of the forming rolls is inserted into the primary formed body; and rotating means for rotating said one of the forming rolls in a state in which the urging force is being applied.

Preferably, the annular projections and the restricting grooves are formed on both the first forming roll and the second rolling form, respectively, in number corresponding to the number of the crest portions or the trough portions of the primary formed roll.

Further, it is preferable that the annular projections and the restricting grooves are formed on the periphery of both the forming rolls in a staggered manner. The radial heights of the annular projections are varied with each other such that the periphery of the trough portions of the bellows section is restricted by the restricting grooves of said one of the forming rolls, and also that the periphery of the crest portions is restricted by the restricting grooves of the other of the forming rolls.

As described hereinabove, according to the method of manufacturing a metallic bellows of the invention, there is an effect in that a metallic bellows can be manufactured which has a small spring constant and in which the plate thickness and the shape of the crest portion and the trough portion of the bellows section can be made substantially uniform while improving the productivity. In addition, the apparatus of manufacturing a metallic bellows of the invention has an effect in that it is suitable for manufacturing a metallic bellows with a small spring constant.

DESCRIPTION OF EXEMPLARY EMBODIMENTS

With reference to FIGS. 1A through 1D, a metallic bellows 1 is used for a flexible tube which is interposed in an exhaust pipe of a vehicle such as a motor vehicle. It is manufactured in two steps by performing the method of manufacturing according to the invention in which are performed a first step of bulging a straight raw pipe 1*a* into a primary formed body 1*b* to thereby form on a periphery thereof a corrugated bellows section 11, and a second step of subjecting at least trough portions 11*b* of the bellows section 11 of the primary formed body 1*b* to roll machining (i.e., forming by subjecting an object to rolling operation) by means of a pair of forming rolls which are described in detail hereinafter. The raw pipe 1*a* is manufactured by continuously rolling a metallic material of stainless steel of a predetermined thickness (e.g., 0.5 mm) into a pipe, then by joining free ends by welding, and by finally cutting it.

Figure 1A:
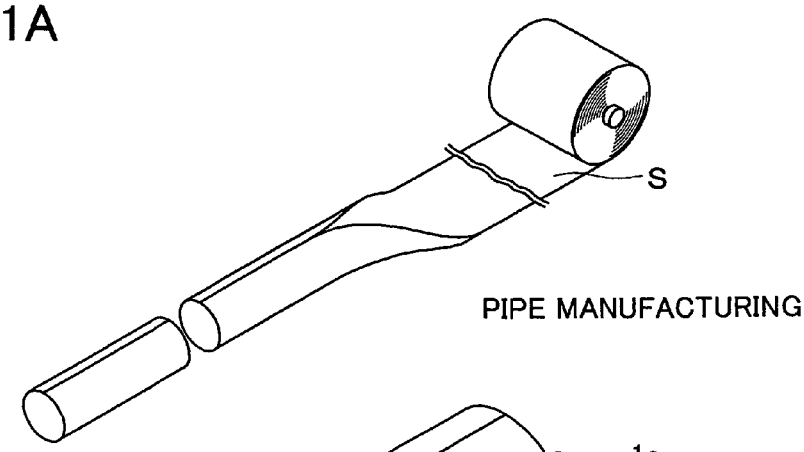
FIGS. 1A thorough 1D are schematic perspective views (FIGS. 1A, 1B) and sectional views (FIGS. 1C, 1D) explaining the steps of manufacturing a metallic bellows.
Figure 1B:
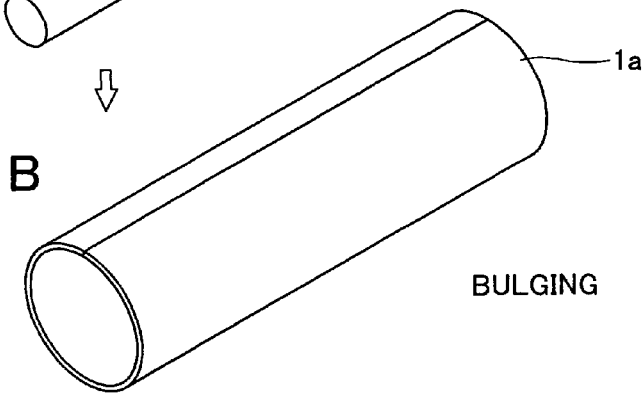
Figure 1C:
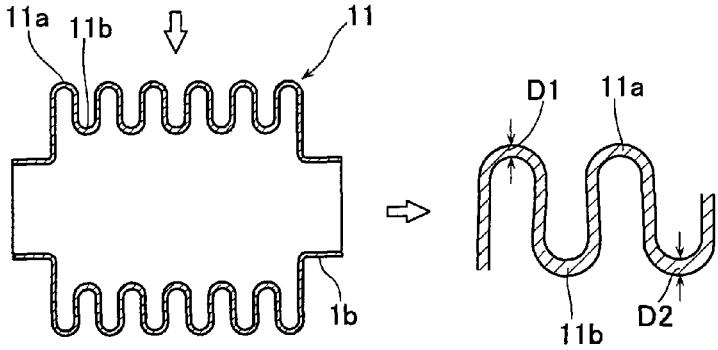
Figure 1D:
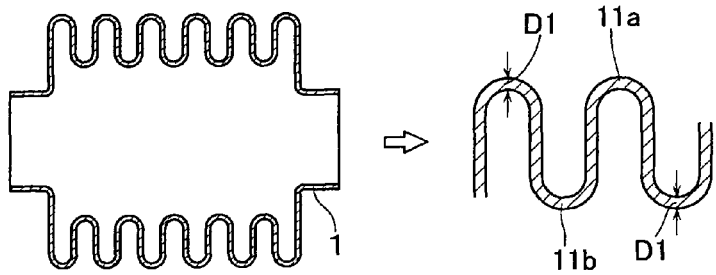
Figure 2A:
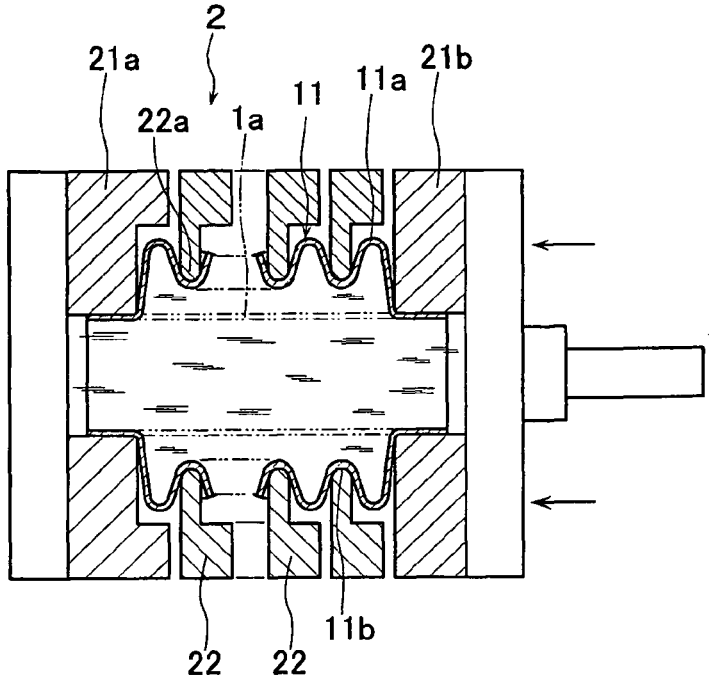
FIGS. 2A and 2B are side views, partly shown in section, of a bulging apparatus for performing a first step (bulging operation).
Figure 2B:
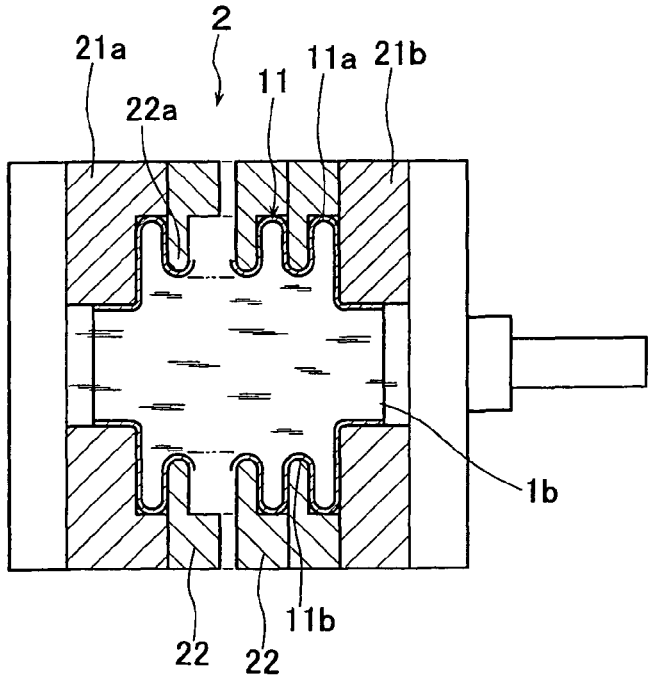

With reference to FIGS. 2A and 2B, a bulging apparatus (apparatus for subjecting an object to bulging operation) 2 for performing the bulging (first step) has a known construction which is made up, e.g., of: a pair of upper and lower end dies 21*a*, 21*b* which serve to hold in position both ends of the raw pipe 1*a* respectively; and a plurality of intermediate annular dies 22 which are disposed at an equal distance from one another so as to correspond to the number of crests (mountains) of the bellows section to be formed in the raw pipe 1*a* and which are moveable in the longitudinal direction (axial direction) of the raw pipe 1*a*.

After having fitted in position both ends of the raw pipe 1*a* by means of the pair of the upper and lower dies 21*a*, 21*b*, the raw pipe 1*a* is internally subjected to fluid pressure in a state in which both end openings of the raw pipe 1*a* are kept hermetically sealed. In this manner, the part to form the crest portions (mountain portions) 11*a* of the bellows section 11 is caused to be swelled (expanded). At the same time, while those parts which form the trough portions (valley portions) 11*b* are kept restricted by annular projections 22*a* of the intermediate dies 22, one 21*b* of the end dies 21*a*, 21*b* is moved toward the other 21*a* of the end dies until the intermediate dies 22 are axially in close contact with one another, thereby performing compression forming in the axial direction. As a result, there is manufactured a primary formed body

1*b* having formed on a periphery thereof a corrugated bellows section 11 in which crest portions 11*a* and trough portions 11*b*, both of U-shaped cross-section, are continuously repeated. In this case, the plate thicknesses of the crest portions 11*a* and the trough portions 11*b* are set to a range within which the joint portion of the raw pipe 1*a* will not be damaged (or will not mechanically fail) even under the pressures of expansion in the radial direction and of compression in the axial direction at the time of bulging operation.

In manufacturing the primary formed body 1*b* in the above-described method, the raw pipe 1*a* is subjected from the inside thereof to the fluid pressure to thereby swell or expand in the radial direction those portions of the bellows section 11 which are expected to form the crest portions 11*a*. Therefore, the plate thicknesses D1 of the crest portions 11*a* become smaller than the plate thicknesses D2 of the trough portions 11*b*, resulting in nonuniform plate thicknesses (see FIG. 1C). In this case, in order to attempt to make smaller the spring constant of the metallic bellows 1, it is necessary to reduce the plate thicknesses D1, D2 of the crest portions 11*a* and the trough portions 11*b* both of which contribute to the spring characteristics.

Figure 3A:
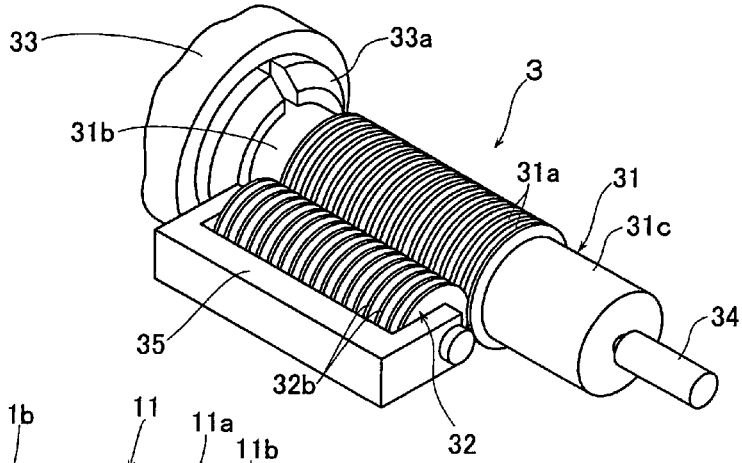
FIGS. 3A through 3C are schematic perspective view (FIG. 3A) and side views (FIGS. 3B, 3C) of an apparatus for performing a second step (roll machining).
Figure 3B:
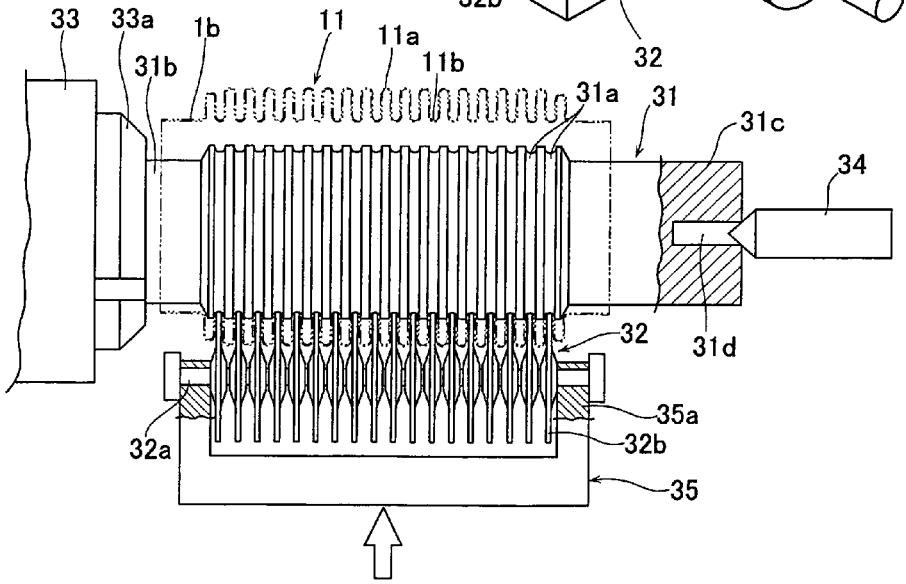
Figure 3C:
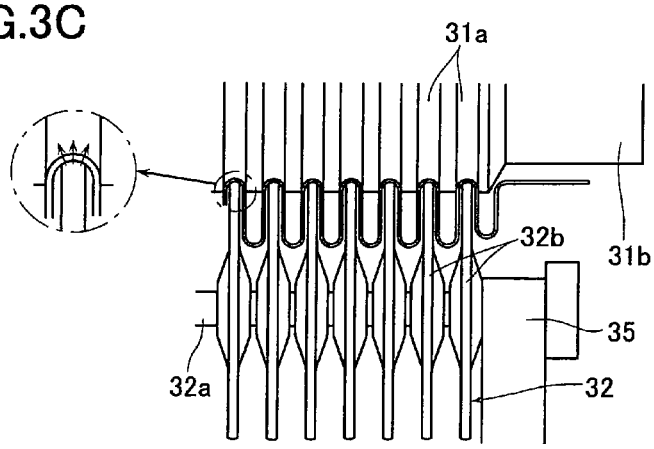

In the embodiment of the invention, the following arrangement has been made: namely, the primary formed body 1*b* is subjected to roll machining to thereby make substantially uniform the plate thicknesses D1, D2 of the crest portions 11*a* and the trough portions 11*b* both of which contribute to the spring characteristics; and also the plate thicknesses are made smaller and the shape thereof is made in good order. With reference to FIGS. 3A through 3C, a roll-machining apparatus 3 which functions to perform the roll-machining step (second step) has a pair of forming rolls 31, 32. The first forming roll 31 is of cylindrical shape having a greater length than the primary formed body 1*b*. On a periphery (outer circumference) at the central portion of the first forming roll 31, there are formed annular restricting grooves 31*a* which coincide with the number of the trough portions 11*b* of the bellows section 11 and which are at the same pitch as that of the adjoining trough portions 11*b*, the restricting grooves 31*a* being of substantially U-shape in cross section and substantially corresponding to the outer shape of the trough portions 11.

The first forming roll 31 has formed therein reduced-diameter portions 31*b*, 31*c* on both longitudinal sides thereof. By means of one 31*b* of the reduced-diameter portion the first forming roll 31 can be chucked in position by a chuck 33*a* of a known construction, the chuck 33*a* being disposed on a rotation stage 33 which is the rotating means provided on the roll-machining apparatus 3. On a side of the other 31*c* of the reduced-diameter portion there is formed a central hole 31*d* into which can be inserted a front end of a spindle 34. The spindle 34 is disposed on the roll-machining apparatus 3 and is designed to apply an urging force toward the center of the rotation stage 33. This central hole 31*d* serves the purpose of aligning the first forming roll 31 to prevent it from rotating off center (i.e., in a misaligned state).

The second forming roll 32 has a rotary shaft 32*a*, which is rotatably supported at the front end (i.e., an end which faces the first forming roll 31) of both projected portions 35*a* of the holder 35 of generally U-shape in cross section. On a periphery (outer circumference) of the rotary shaft 32*a* there are formed, in an annular manner, projections 32*b* which coincide in number with that of the trough portions 11*b* in the bellows section 11 and which are also provided at a pitch that is the same as the pitch between the adjoining trough portions 11*b*. On the other hand, the holder 35 is connected to an urging means which is a fluid cylinder (not illustrated). Due to this urging means, the front end portion of the projections 32*b* can apply an urging force in the radial direction to the trough portions 11*b* of the bellows section 11. In this case, the front end portion of the respective projections 32*b* is set to have a thickness which can allow an urging force to be applied, through the space between each set of the adjoining crest portions 11*a*, to the U-shaped apex of the trough portion 11*b*.

A description will now be made about the roll machining of the trough portions 11*b* of the primary formed body 1*b*. First, in a state in which one 31*b* of the reduced-diameter portion of the first forming roll 31 is kept chucked by the chuck 33*a* of the rotary stage 33, the primary formed body 1*b* is disposed so that both the reduced-diameter portions 31*b*, 31*c* are protruded from both axial sides of the primary formed body 1*b*. Then, the front (or free) end of the spindle 34 is inserted into the central hole 31*d* which is formed on the side of the other 31*c* of the reduced-diameter portion. While applying an urging force to the spindle, the first forming roll 31 is aligned and set in position.

Then, the primary formed body 1*b* is aligned relative to the first forming roll 31 so that each of the trough portions 11*b* of the bellows section 11 coincides with each of the restricting grooves 31*a* in the radial direction. In this state, the holder 35 is moved by operating the urging means such that the front end of each of the projections 32*b* respectively comes into contact with the periphery of each of the trough portions 11*b* from the outside of the primary formed body 1*b*. When an urging force in the radial direction is applied by means of the projections 32*b* of the second forming roll 32 to each of the trough portions 11*b*, a motor of the rotary stage 33 is driven to rotate the rotary stage 33.

Once the rotary stage 33 rotates, the first forming roll 31 rotates to thereby cause the second forming roll 32 to rotate. The first forming roll 1*b* itself will also be rotated through friction between the respective forming rolls 31, 32. At this time, as a result of applying the urging force to each of the trough portions 11*b* by the respective projections 32*b*, each of the trough portions 11*b* will be elongated toward the diametrically inside of the primary formed body 1*b*. The plate thicknesses of the trough portions 11*b* will thus be reduced over the entire circumference. Then, the trough portions 11*b* are restricted by the restricting grooves 31*a* and will, consequently, be formed into U-shape along the restricting grooves 31*a*. In this case, if the shape of the restricting grooves 31*a* and the urging force of the holder 35 are appropriately set depending on the amount of reduction in plate thickness of the trough portions 11*b* based on the difference in plate thickness between the crest portions 11*a* and the trough portions 11*b*, it is possible to make the plate thickness of the trough portions 11*b* to coincide with the plate thickness of the crest portions 11*a* at the time of bulging. In this manner, the metallic bellows 1 can be made smaller in the spring constant.

Finally, once the rotation of the rotary stage 33 has been stopped, the holder 35 is moved in the opposite radial direction (i.e., away from the first forming roll 31) to thereby release the urging force against the metallic bellows 1. Then, the spindle 34 is moved in the opposite direction (i.e., away from the central hole 31*d*), and the metallic bellows 1 is moved in the radial direction to get the projections 32*b* out of engagement with the crest portions 11*a*, thereby pulling out the metallic bellows out of the first forming roll 31.

In this embodiment, a description has so far been made about an example in which the plurality of projections 32*b* are disposed on the second forming roll 32 in order to perform bulging to all of the trough portions 11*b* whose plate thicknesses get larger during the bulging. However, the invention is not necessarily limited to such an example; instead, it may be so arranged that a forming roll, e.g., with a single projection is used so that, while the holder 35 is moved in the axial direction, roll machining is performed on each of the trough portions. On the other hand, in case roll machining is performed on all of the crest portions 11*a*, there may be used a pair of forming rolls made up of a first forming roll 31 having formed therein a projection, and a second forming roll 32 having formed therein restricting grooves (not illustrated).

Further, in this embodiment, the following arrangement has been made. That is, the plate thickness D1 of the crest portions 11*a* is used as a reference. This plate thickness D1 is set such that the plate thickness of the crest portions 11*a* can be made smaller to the extent possible within a range in which the joint portion of the raw pipe 1*a* does not fail at the time of bulging. Without being limited thereto, another arrangement may also be made such that a crest portion 11*a* has a sufficient plate thickness at which the connecting portion of the raw pipe 1*a* is not damaged even under forces of swelling in the radial direction and of compression in the axial direction. While subjecting the crest portions 11*a* and the trough portions 11*b* of the bellows section 11 simultaneously to roll machining to thereby form the crest portions 11*a* and the trough portions 11*b* substantially into U-shape, the plate thicknesses may uniformly be made thin.

Figure 4:
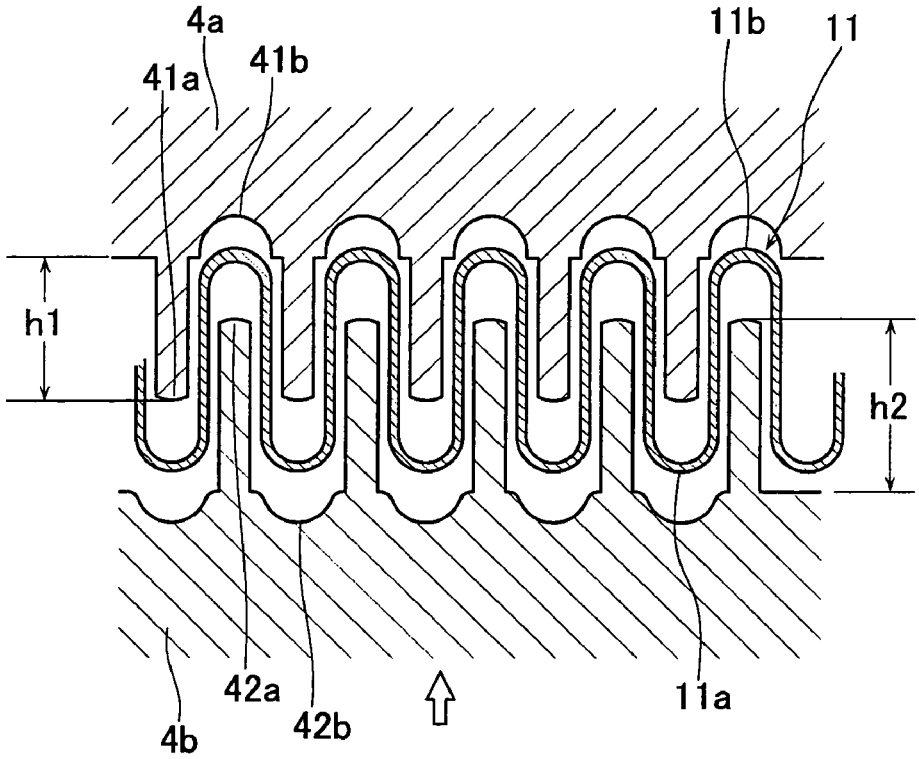
FIG. 4 is a sectional view of a modified example of a roll-machining apparatus as shown, e.g., in FIG. 3C.

In other words, as shown in FIG. 4, a pair of forming rolls 4*a*, 4*b* have substantially the same embodiments. On a periphery of the respective forming rolls 4*a*, 4*b*, there are formed, in a staggered manner, projections 41*a*, 42*a* and restricting grooves 41*b*, 42*b* in a manner to respectively correspond to the crest portions 11*a* and the trough portions 11*b* of the bellows section 11 and also at the same pitch with each other. In this case, the following setting may be made. That is, the trough portions 11*b* that have gained in plate thickness at the time of bulging will be elongated first by the projections 42*a*, thereby reducing the plate thickness. When this plate thickness becomes substantially the same as the plate thickness of the crest portions 11*a* having a smaller plate thickness, the crest portions 11*a* and the trough portions 11*b* are simultaneously elongated to thereby reduce the plate thicknesses. They are then respectively restricted by the restricting grooves 41*b*, 42*b* lying opposite to both the projections 41*a*, 42*a*. In order to attain the above, the radial height h2 of the projection 42*a* of the forming roll 4*b* to be rotatably supported by the holder 35 must be arranged to be greater than the radial height h1 of the projection 41*a* of the first forming roll 4*a* to be inserted into the first formed body 1*b*. Also, the depth of the restricting grooves 41*b* must be set to become greater accordingly than the depth of the restricting grooves 42*b*.

According to this configuration, the following two jobs can be performed in a single roll machining: i.e., the first job being to make smaller the plate thickness of the crest portions 11*a* which, within the bellows section 11, become thin at the time of bulging and then to put the shape in order; and the second job being to make uniform the plate thickness of the trough portion 11*b* based on the plate thickness of the crest portion 11*a* and then to put the shape in order. As a result, the productivity can be further improved and the spring constant of the metallic bellows 1 can be made smaller.

Further, in the embodiment of the invention, the raw pipe 1*a* has been defined to be made by continuously forming a metallic material of a given thickness into a pipe and then by welding the free ends together, followed by cutting the welded pipe. Without being limited to this embodiment, the method of manufacturing a metallic bellows of the invention can also be applied to an example in which a raw pipe is manufactured by putting a plurality of (e.g., two) metallic sheets together and then a metallic bellows is manufactured with the raw pipe thus obtained.

Figure 5A:
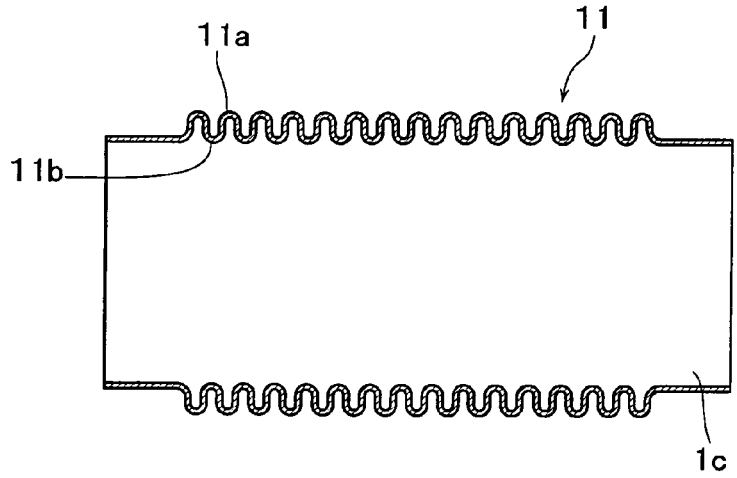
FIGS. 5A and 5B are sectional side views showing the manufacturing of a metallic bellows having a bellows section with a cross-section substantially similar to a Greek capital letter omega and FIG. 5C is a partial enlarged sectional view of the metallic bellows.
Figure 5B:
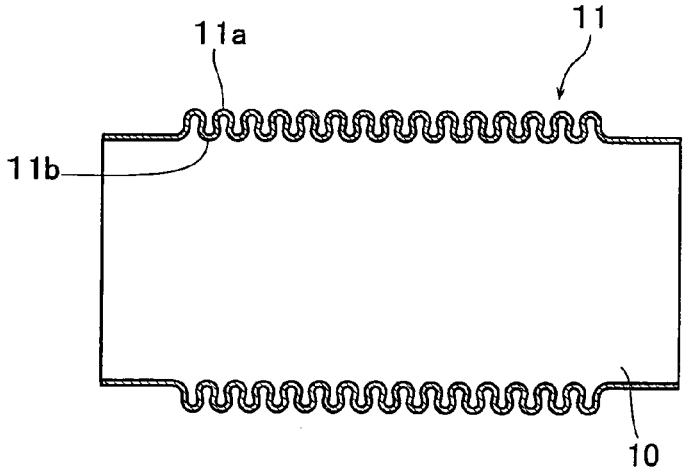
Figure 5C:
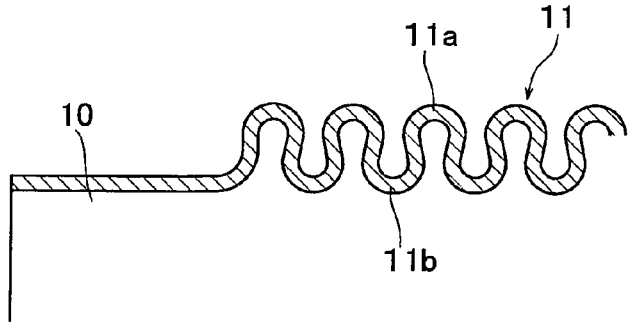

Still furthermore, in this embodiment, a description has been made of an example in which the crest portion 11*a* and the trough portion 11*b* of the bellows section 11 are of substantially U-shape in cross-section. Without being limited to the example, this invention can also be applied to a case in which, as shown in FIG. 5, there is prepared a secondary formed body 1*c* having the crest portion 11*a* and the trough portion 11*b* in the bellows section 11 in substantially U-shape in cross-section, in the same steps as in the above-described example. This secondary formed body 1*c* is then subjected to compression-forming to thereby obtain a metallic bellows 10 substantially having a cross-section similar to a Greek capital letter omega.

It is further understood by those skilled in the art that the foregoing is the preferred embodiment of the invention, and that various changes and modifications may be made without departing from the spirit and scope thereof.

What is claimed is:

1. A method of manufacturing a metallic bellows comprising:

a first step of bulging a straight raw pipe into a primary formed body having formed on a periphery thereof a corrugated bellows section thereby creating at least a curved crest portion and a curved trough portion in the first step; and a second step of subjecting at least one of curved crest portions and curved trough portions of the bellows section of the primary formed body to roll machining by means of a pair of forming rolls, wherein the second step comprises:

inserting a first forming roll into the primary formed body;

applying an urging force to a second forming roll toward the first forming roll in a state in which annular projections formed on a periphery of one of the first forming roll and the second forming roll are radially in contact with the at least one of crest portions and trough portions of the bellows section; and rotating the first forming roll in a state in which the urging force by the second forming roll is being applied thereto, until the periphery of the at least one of the crest portions and the trough portions is restricted by annular restricting grooves formed on a periphery of the other of the first forming roll and the second forming roll.

2. The method according to claim 1, wherein the annular projections and the restricting grooves are formed on both the first forming roll and the second rolling form, respectively, in number corresponding to the number of the crest portions or the trough portions of the primary forming roll, such that the urging force can be applied by the annular projections to all the crest portions or the trough portions of the bellows section.

3. The method according to claim 2, wherein the annular projections and the restricting grooves are formed respectively on the periphery of the first forming roll and the second forming roll in a staggered manner, the radial height of the annular projections of the first forming roll varying from the radial height of the annual projections of the second forming roll, such that, when the urging force is applied by the second forming roll, the periphery of the trough portions is restricted by the restricting grooves of the first forming roll, and that the periphery of the crest portions is restricted by the restricting grooves of the second forming roll.

4. The method according to claim 1, wherein the annular projections and the restricting grooves are formed respectively on the periphery of the first forming roll and the second forming roll in a staggered manner, the radial height of the annular projections of the first forming roll varying from the radial height of the annual projections of the second forming roll, such that, when the urging force is applied by the second forming roll, the periphery of the trough portions is restricted by the restricting grooves of the first forming roll, and that the periphery of the crest portions is restricted by the restricting grooves of the second forming roll.

5. The method according to claim 4, the second step further comprising:

performing the restriction by the restricting grooves of the first forming roll and the restriction by the restricting grooves of the second forming roll simultaneously.

6. The method according to claim 1, wherein the second step further comprises:

rotating the first forming roll in a state in which the urging force by the second forming roll is being applied thereto, until a periphery of the at least one of the crest portions and the trough portions is restricted by annular restricting grooves formed on a periphery of the other of the first forming roll and the second forming roll thereby creating substantial uniform plate thicknesses of the at least one of the curved crest portions and the curved trough potions at the bellows relative to remaining bellow portions.

7. The method according to claim 6, the second step further comprising:

performing the rotating and the creating simultaneously.

8. The method according to claim 1, wherein the second step further comprises:

rotating the first forming roll in a state in which the urging force by the second forming roll is being applied thereto, until a periphery of the at least one of the crest portions and the trough portions is restricted by annular restricting grooves formed on a periphery of the other of the first forming roll and the second forming roll thereby creating substantial uniform plate shape of at least the at least one of the curved crest portions and the curved trough potions at the bellows.

9. The method according to claim 8, the second step further comprising:

performing the rotating and the creating simultaneously.

10. A method of manufacturing a metallic bellows comprising:

a first step of bulging a straight raw pipe into a primary formed body having formed on a periphery thereof a corrugated bellows section; and a second step of subjecting at least one of crest portions and trough portions of the bellows section of the primary formed body to roll machining by means of a pair of forming rolls, wherein the second step comprises:

inserting a first forming roll into the primary formed body;

applying an urging force to a second forming roll toward the first forming roll in a state in which annular projections formed on a periphery of one of the first forming roll and the second forming roll are radially in contact with at least one of the trough portions of the bellows section; and rotating the first forming roll in a state in which the urging force by the second forming roll is being applied thereto, until the periphery of the one of the trough portions is restricted by a radially inner curved surface of annular restricting grooves formed on a periphery of the other of the first forming roll and the second forming roll.

* * * * *